United States Patent [19]

Luk

[11] Patent Number: 4,492,318

[45] Date of Patent: Jan. 8, 1985

[54] WATER PISTOL

[75] Inventor: Ka-Shiu Luk, Hong Kong, Hong Kong

[73] Assignee: Heep Tung Manufactory Limited, Kowloon, Hong Kong

[21] Appl. No.: 402,005

[22] Filed: Jul. 26, 1982

[30] Foreign Application Priority Data

Aug. 5, 1981 [GB] United Kingdom ..... 8123953

[51] Int. Cl.[3] ..... A63H 3/18

[52] U.S. Cl. ..... 222/79; 239/587

[58] Field of Search ..... 222/79, 526, 533; 239/587

[56] References Cited

U.S. PATENT DOCUMENTS 2,746,644 5/1956 Steiner ..... 222/79

3,220,657 11/1965 Nyden ..... 239/587

3,563,471 2/1971 Watkin ..... 239/587

FOREIGN PATENT DOCUMENTS 1045847 10/1966 United Kingdom ..... 222/79

*Primary Examiner*—Stanley H. Tollberg

*Attorney, Agent, or Firm*—Townsend and Townsend

[57] ABSTRACT

A jet of water is emitted in known toy water pistols through the muzzle of the barrel, and accordingly people thus know as to who is a potential target by simply observing the direction the gun is pointed. A toy water pistol in accordance with the invention comprises a hollow body in the shape of a gun having a simulated muzzle through which it can be assumed that a jet of water will issue. Mounted above the gun barrel is the actual water outlet which is formed in the cylindrical wall of a round knob like member mounted so as to be capable of rotation through 360° whereby the user can turn the knob to place the outlet in any desired or arbitrary orientation relative the barrel and simulated muzzle, so that in use a jet of water is emitted in a direction which is not obvious to people who are potential targets.

7 Claims, 2 Drawing Figures

WATER PISTOL

This invention relates to water pistols.

BACKGROUND TO THE INVENTION

Water pistols are well known and generally they provide a jet or squirt of water through the muzzle of the pistol. Therefore when the pistol is pointed and aimed at a particular person, the jet of water will be directed towards that person.

It is an object of the present invention to provide a water pistol where the direction of the jet of water comes as a surprise to persons who are potential targets.

BRIEF SUMMARY OF THE INVENTION

According to the invention there is provided a toy water pistol comprising a hollow body in the shape of a gun having a simulated muzzle through which it can be assumed that a jet of water will issue and mounted above the gun barrel, the actual water outlet formed in the cylindrical wall a round knob like member mounted to as to be capable of rotation through 360° whereby the user can turn the knob to place the nozzle in any desired or arbitrary orientation relative the barrel and simulated muzzle so that in use a jet of water is emitted in a direction which is not obvious to people who are potential targets.

Such a toy water pistol can provide an extra element of surprise and fun during its use and indeed the direction of the jet of water could be a surprise to the user of the gun. Thus it is possible for someone to direct the jet backwards at the user and hand the gun to some who assumes that the water jet will issue forwardly from the simulated muzzle.

BRIEF DESCRIPTION OF THE DRAWINGS

An example of the toy water pistol according to the invention will now be described with reference to the accompanying drawings, in which.

DESCRIPTION OF THE PREFERRED EMBODIMENTS

Figure 1:
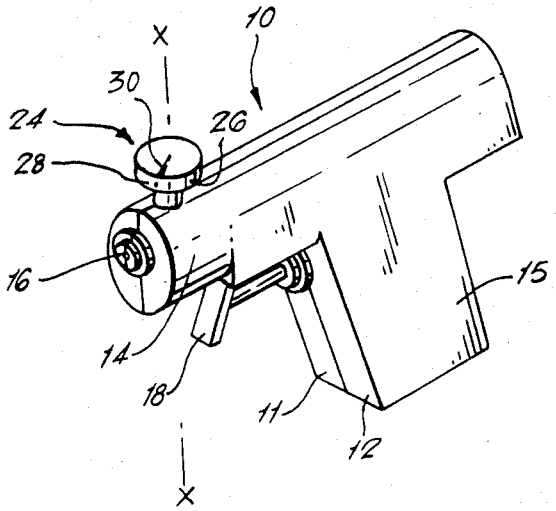
FIG. 1 is a perspective view of the toy water pistol.
Figure 2:
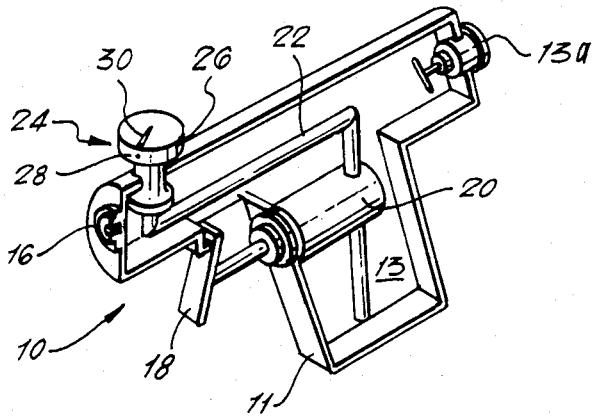
FIG. 2 is a perspective half-section showing the interior working parts of the pistol.

The toy water pistol 10 shown in the drawings has an outer gun-shaped body made up of two opposite half shells 11 and 12. These shells are shaped to give the water pistol an appearance simulating a toy gun or pistol and are for example made from mouldings of rigid synthetic plastics material. The two shells define between themselves a hollow reservoir 13 for storing water. An inlet for water is provided at the rear and a plug 13*a* temporarily seals that inlet.

The pistol has conventional parts including a barrel 14 and a grip 15. At the front of the barrel is what appears to be a muzzle 16 and potential victims or targets of the water pistol are led to assume that a water jet will issue from that muzzle. In fact the muzzle is completely closed and sealed.

The water pistol also has a trigger 18 which operates a conventional pump 20 to pump a quantity of water along a delivery tube 22.

Mounted above the barrel is a cylindrical knob 24 having a cylindrical side 26. In the cylindrical side edge is provided a small nozzle 28. The knob is hollow and is rotatably joined and sealed to the delivery tube 22. It is therefore free to be rotated through 360° about the upright axis X—X but remains in sealing connection with the delivery tube 22. Thus, when the trigger 18 is depressed, water is sucked from the reservoir 13, passed to the delivery tube 22 and into the interior of the knob 24 and leaves as a jet through the nozzle 28.

Because the nozzle can be oriented at any angle about the axis X—X and because the knob 24 has no apparent direction in which the nozzle is pointing and the nozzle is in any case so small as to be hardly visible, it can be a complete surprise to potential victims or targets when the trigger is depressed as to which direction the water pistol issues. Thus the pistol can apparently be aimed at one person and the water jet issue sideways at someone else. Equally a user can be tricked into believing that the water jet will issue through the muzzle 16 whereas in fact when he presses the trigger the jet could be directed straight back at him.

If desired, a small marking such as the ridge 30 can be provided on the top of the knob so that experienced users of the water pistol will know the direction of orientation of the water jet.

A flange can be provided on the portion of the knob 24 inside the barrel 14 to retain the knob 24 on the barrel 14.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A toy water pistol comprising:

a hollow body in the shape of a gun to constitute a water reservoir, said body including, a gun barrel, a grip, a simulated muzzle mounted on said gun barrel through which it can be assumed that a jet of water will issue, a round knob-like member mounted above said gun barrel having, a cylindrical wall with a water outlet formed therein said water outlet being of such dimensions and located in said cylindrical wall in such a manner as not to be obviously visible to an observer; and means to allow said knob-like member to rotate through 360° whereby the user can turn said knob member to place the outlet in any desired or arbitrary orientation relative said barrel and simulated muzzle, wherein the pistol further includes a trigger, and a pump capable of pumping water from said hollow body to the water outlet in said cylindrical wall on operation of said trigger, whereby a jet of water is emitted in a direction which is not obvious to people who are potential targets, including the user.

2. A toy water pistol as claimed in claim 1 wherein said round knob-like member is capable of rotation about an axis perpendicular to the longitudinal axis of said gun barrel.

3. A toy water pistol as claimed in claim 1 wherein said simulated muzzle is closed and sealed.

4. A toy water pistol as claimed in claim 2 wherein said simulated muzzle is closed and sealed.

5. A toy water pistol as claimed in any preceding claim wherein said round knob like member has means to indicate the direction of orientation of the water jet.

6. A toy water pistol as claimed in any one of claims 1 to 4 wherein said round knob-like member has means to retain the member on said barrel.

7. A toy water pistol comprising:

a hollow body in the shape of a gun to constitute a water reservoir, said body including, a gun barrel, a grip, a simulated muzzle mounted on said gun barrel through which it can be assumed that a jet of water will issue, a substantially cylindrical member mounted above said gun barrel and defining a water outlet opening through which a water jet can issue and which is arranged to be substantially invisible from a location within the reach of the water jet, means for rotating the cylindrical member through 360° whereby the user can turn said cylindrical member to place the outlet opening in any desired orientation relative said barrel and simulated muzzle, a trigger, and a pump capable of pumping water from said hollow body to the water outlet opening on operation of said trigger, whereby the water jet is emitted in a direction which is not obvious to people, including the user, who are potential targets.

* * * * *